US005128847A

United States Patent [19]

Lin et al.

[11] Patent Number: 5,128,847

[45] Date of Patent: Jul. 7, 1992

[54] DETACHABLE, LOW WATTAGE TRACK MOUNTING LAMP

[76] Inventors: Johnson Lin, No. 7-2, Lane 10, Chiao Chung 2th St., Panchiaw City, Taipei Hsien; Dougalas Lin, 2F, No. 14, Lane 22, Szu Wei Rd., Taipei, both of Taiwan

[21] Appl. No.: 620,204

[22] Filed: Nov. 30, 1990

[51] Int. Cl.[5] ..... H01R 33/46; F21V 21/34; F21V 23/02

[52] U.S. Cl. ..... 362/226; 362/239; 362/147; 439/118

[58] Field of Search ..... 362/404, 238, 239, 147, 362/226, 141, 145; 439/110, 111, 112, 115, 116, 117, 118, 119, 665

[56] References Cited

U.S. PATENT DOCUMENTS

| | | | |
|---|---|---|---|
| 4,443,778 | 4/1984 | Mewissen | 336/90 |
| 4,677,411 | 6/1987 | Hofmann et al. | 336/92 |
| 4,688,154 | 8/1987 | Nilssen | 362/147 |
| 4,828,505 | 5/1989 | Shwisha | 439/119 |
| 4,851,973 | 7/1989 | Layne | 362/147 |

FOREIGN PATENT DOCUMENTS

| | | | |
|---|---|---|---|
| 236855 | 7/1911 | Fed. Rep. of Germany | 336/107 |
| 395005 | 12/1908 | France | 336/107 |
| 274459 | 3/1934 | Italy | 336/107 |
| 240953 | 8/1925 | United Kingdom | 336/107 |
| 493621 | 10/1938 | United Kingdom | 336/107 |

*Primary Examiner*—Ira S. Lazarus
*Assistant Examiner*—L. Heyman
*Attorney, Agent, or Firm*—Lowe, Price, LeBlanc & Becker

[57] ABSTRACT

A detachable, low wattage track mounting lamp of the type comprising a track for mounting at least a project lamp via a transformer, wherein said transformer has two hooked conductors fastened in said track and electrically connected to a power supply, and said project lamp has hooked conductors electrically fastened in said transformer. Either said project lamp or said transformer can be detached for replacement when damaged.

2 Claims, 4 Drawing Sheets

DETACHABLE, LOW WATTAGE TRACK MOUNTING LAMP

BACKGROUND OF THE INVENTION

The present invention relates to lamps, and more particularly relates to a detachable, low wattage track mounting lamp which can be conveniently detached for replacement of the parts thereof.

Conventionally, a low wattage track mounting lamp is generally made in a solid unit in which the transformer is fixedly incorporated with the project lamp. When transformer is damaged, the whole assembly becomes useless. It is therefore the main object of the present invention to provide a detachable, low wattage, track mounting lamp in which the transformer can be conveniently detached from the project lamp for replacement when it is damaged.

SUMMARY OF THE INVENTION

A detachable, low wattage track mounting lamp of the type comprising a track for mounting at least a project lamp via a transformer, wherein said transformer has two hooked conductors fastened in said track and electrically connected to a power supply, and said project lamp has hooked conductors electrically fastened in said transformer. Either said project lamp or said transformer can be detached for replacement when damaged.

BRIEF DESCRIPTION OF THE DRAWINGS

The present invention will now be described by way of examples, with reference to the annexed drawings, in which.

DETAILED DESCRIPTION OF THE PREFERRED EMBODIMENTS

Figure 1:
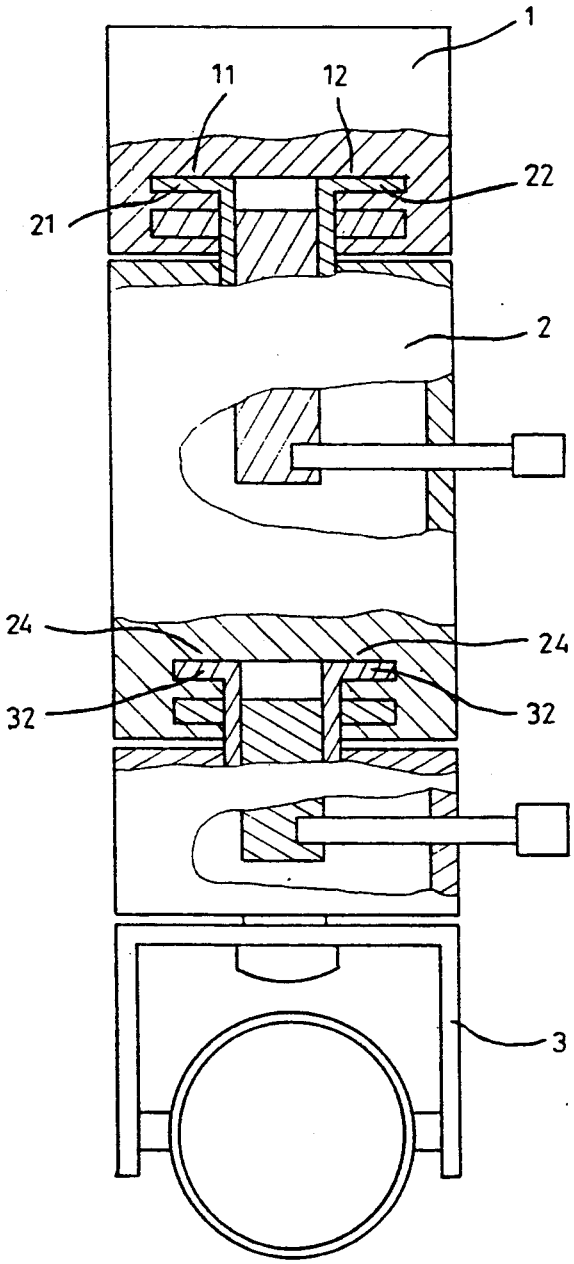
FIG. 1 is a plain sectional view of the present invention.
Figure 2:
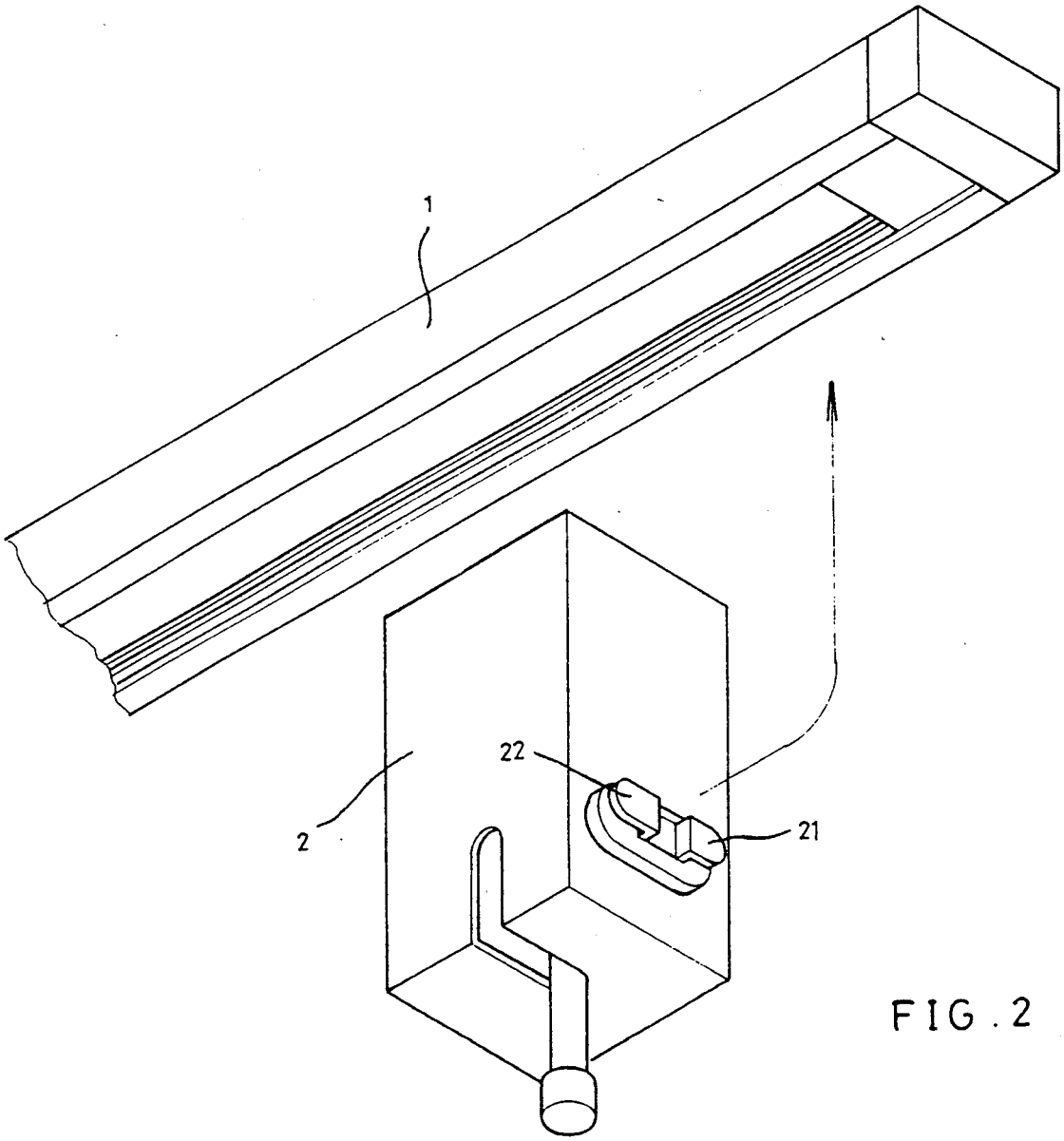
FIG. 2 is a schematic drawing illustrating a procedure to install a transformer in a track according to the present invention.
Figure 3:
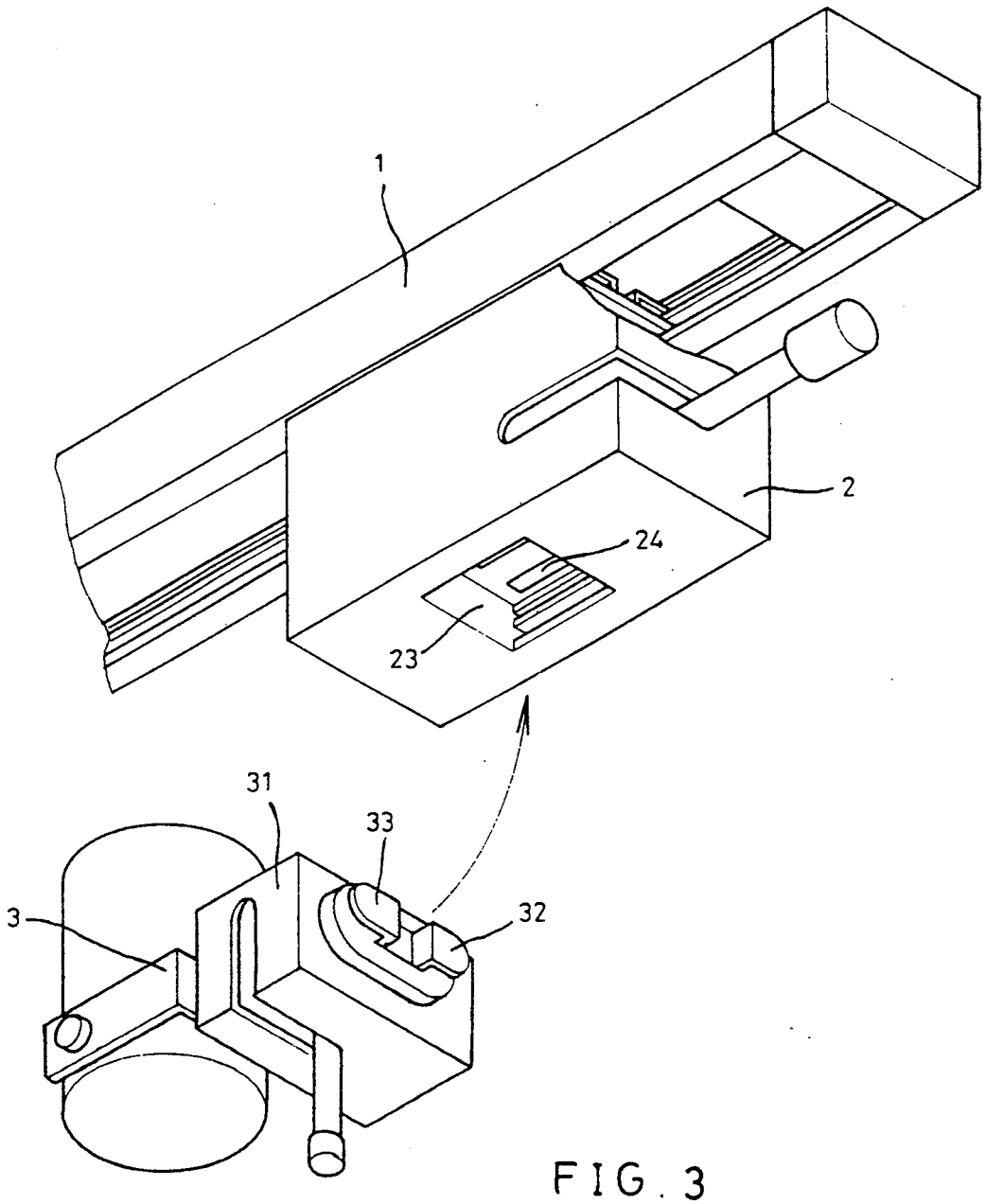
FIG. 3 is a schematic drawing illustrating a procedure to install a project lamp in a transformer which is attached to a track according to the present invention.

Referring to FIGS. 1 through 3, therein illustrated is a track mounting lamp embodying the present invention and generally comprised of track 1, transformer 2, and project lamp 3. The track 1 is similar to the known art, having two strip conductors 11 and 12 inside the groove defined therein. The transformer 2 comprises a casing having two strip conductors 21 and 22 transversely disposed at the top and another two strip conductors 24 and 25 disposed inside a square recess 23 at the bottom thereof. The project lamp 3 comprises a bracket 31 having two strip conductors 32 and 33 transversely disposed at the top.

Installation of the present invention is outlined hereinafter. Insert the bracket 31 of the project lamp 3 in the square recess 23 of the transformer 2, permitting the strip conductors 32 and 33 of the project lamp 3 to respectively hook up with the strip conductors 24 and 25 of the transformer 2. Then, insert the transformer 2 in the track 1, permitting the top strip conductors 21 and 22 of the transformer 2 to respectively engage with the strip conductors 11 and 12 of the track 1. Therefore, electric current which is connected to the track 1 can be connected from the strip conductors 11 and 12 of the track 1 through the strip conductors 21 and 22, and the strip conductors 24 and 25 of the transformer 2 to the strip conductors 32 and 33 of the project lamp 3. By means of the aforesaid arrangement, the transformer 2 can be conveniently detached for replacement if it is damaged.

Figure 4:
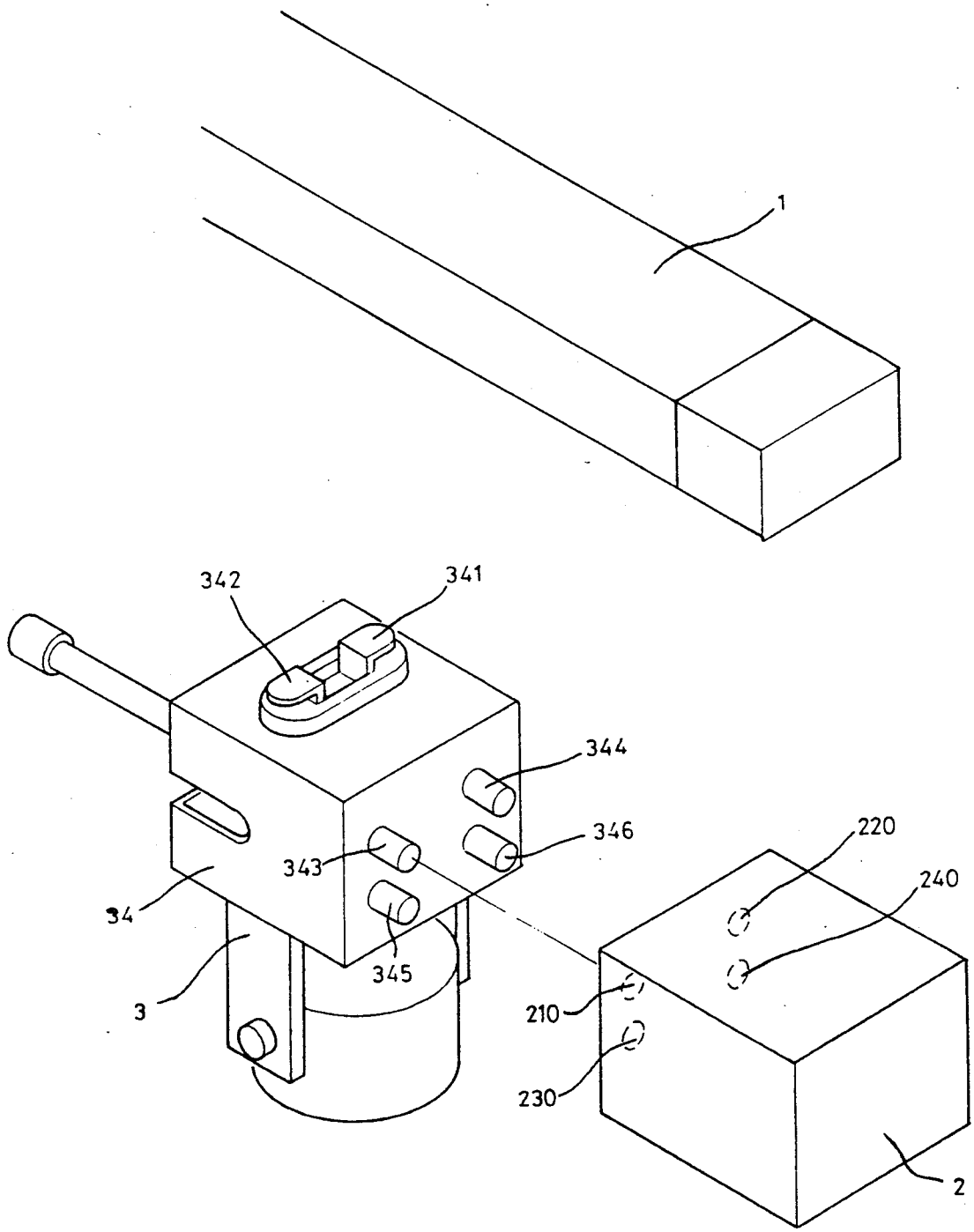
FIG. 4 illustrates an alternate form of the present invention.

Referring to FIG. 4, there is illustrated an alternate form of the present invention. In this embodiment of track lamp assembly, the project lamp 3 comprises a junction box 34 at the top, which junction box 34 has two strip conductors 341 and 342 transversely disposed at the top and two pairs of conductive plug pins 343, 344 and 345, 346 at one side. The transformer 2 comprises two pairs of conductive plug holes 210, 220 and 230, 240 at one side for fastening the conductive plug pins 343, 344 and 345, 346 of the junction box 34. Therefore, by inserting the conductive plug pins 343, 344 and 345, 346 of the junction box 34 in the conductive plug holes 210, 220 and 230, 240 of the transformer 2, the transformer 2 can be firmly attached to the junction box 34. After the transformer 2 is attached to the junction box 3, the junction box 34 is fastened in the track 1 permitting the strip conductors 341 and 342 of the junction box 34 to respectively engage with the two strip conductors 11 and 12 of the track 1. Therefore, electric current can be conducted from the strip conductors 11 and 12 of the track 1 through the strip conductors 341 and 342 and the first pair of conductive plug pins 343 and 344 of the junction box 34 to the first pair of conductive plug holes 210 and 220 of the transformer 2 from which electric current is further connected through the second pair of conductive plug holes 230 and 240 of the transformer 2 to the project lamp 3 via the second pair of conductive plug pins 343 and 344. By means of this arrangement, the transformer 2 can be conveniently detached for replacement if it is damaged.

We claim:

1. A detachable, low wattage track mounting lamp comprising:

a track defining an elongate groove, a pair of first strip conductors mounted in said groove; a casing having a second pair of strip conductors on the upper side thereof forming first bayonet projections, received in he track so that said first and second conductors are in electrical contact, said casing forming a rectangular recess in a lower side and third strip conductors mounted in said recess; a lamp having a mounting bracket, said bracket mounting fourth strip conductors forming second bayonet projections received in the recess in said casing so that said third and fourth conductors are in electrical contact; and a transformer electrically coupled between said second and third conductors.

2. The track mounting lamp of claim 1 further comprising:

a junction box mounted in said casing and coupled to said second pair of conductors said casing mounting two conductive plug pin means at a side thereof, a first of said means electrically coupled through said junction box to said second conductors and a second of said plug pin means electrically coupled to said third pair of conductors; and a transformer having two conductive means for releasably coupling, respectively, with said plug pin means whereby when said first conductors are energized a circuit will be completed through said transformer to said lamp.

* * * * *